US011131472B2

(12) United States Patent
Lee et al.

(10) Patent No.: US 11,131,472 B2
(45) Date of Patent: Sep. 28, 2021

(54) AIR CONDITIONER AND DEFROST CONTROL METHOD THEREFOR

(71) Applicant: LG ELECTRONICS INC., Seoul (KR)

(72) Inventors: Jaewon Lee, Seoul (KR); Woojoo Choi, Seoul (KR); Jinhyoung Park, Seoul (KR); Youngjoo Shin, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/772,637

(22) PCT Filed: Sep. 24, 2019

(86) PCT No.: PCT/KR2019/012425
§ 371 (c)(1),
(2) Date: Jun. 12, 2020

(87) PCT Pub. No.: WO2020/111479
PCT Pub. Date: Jun. 4, 2020

(65) Prior Publication Data

US 2021/0080140 A1 Mar. 18, 2021

(30) Foreign Application Priority Data

Nov. 29, 2018 (KR) ..... 10-2018-0150743

(51) Int. Cl.
*F25B 47/02* (2006.01)
*F24F 11/42* (2018.01)
*F25B 6/02* (2006.01)

(52) U.S. Cl.
CPC ..... *F24F 11/42* (2018.01); *F25B 6/02* (2013.01); *F25B 47/02* (2013.01)

(58) Field of Classification Search
CPC ..... F24F 11/42; F24F 47/02; F24F 47/022; F24F 47/025; F25B 6/02
See application file for complete search history.

(56) References Cited

U.S. PATENT DOCUMENTS 4,151,722 A * 5/1979 Willitts ..... F25B 47/022 340/518
5,704,221 A * 1/1998 Lego ..... F25B 5/02 62/278

(Continued)

FOREIGN PATENT DOCUMENTS

JP 2013-011364 1/2013
JP 2016-031182 3/2016

(Continued)

OTHER PUBLICATIONS

International Search Report dated Jan. 14, 2020 issued in Application No. PCT/KR2019/012425.

(Continued)

*Primary Examiner* — Jonathan Bradford
(74) *Attorney, Agent, or Firm* — KED & Associates LLP

(57) ABSTRACT

An air conditioner includes an outdoor heat exchanger in which N heat exchange units are spaced apart from one another sequentially in a vertical direction N expansion valves respectively connected to the N heat exchange units; N hot gas pipes respectively connected to the N heat exchange units; N hot gas valves respectively installed in the N hot gas pipes; and a controller configured to control the N expansion valves and the N hot gas valves to defrost the N heat exchange units, wherein the controller is configured to defrost a bottom heat exchange unit first, then defrost a top heat exchange unit, and defrost the heat exchange units located under the top heat exchange unit sequentially from (Continued)

a second highest heat exchange unit to the bottom heat exchange unit after defrosting the top heat exchange unit.

18 Claims, 9 Drawing Sheets

(56) References Cited

U.S. PATENT DOCUMENTS

| | | | | |
|---|---|---|---|---|
| 2007/0119196 | A1* | 5/2007 | Wellman | F25B 47/022 62/151 |
| 2013/0019622 | A1* | 1/2013 | Nakashima | F25B 13/00 62/160 |
| 2014/0116078 | A1 | 5/2014 | Doumyou et al. | |
| 2014/0165628 | A1* | 6/2014 | Tamura | F25B 47/022 62/80 |

FOREIGN PATENT DOCUMENTS

| | | |
|---|---|---|
| KR | 10-2012-0114997 | 10/2012 |
| KR | 10-2013-0032681 | 4/2013 |
| KR | 10-1401909 | 5/2014 |
| KR | 10-1572845 | 11/2015 |
| KR | 10-1737365 | 5/2017 |

OTHER PUBLICATIONS

Written Opinion dated Jan. 14, 2020 issued in Application No. PCT/KR2019/012425.

* cited by examiner

AIR CONDITIONER AND DEFROST CONTROL METHOD THEREFOR

CROSS-REFERENCE TO RELATED PATENT APPLICATIONS

This application is a U.S. National Stage Application under 35 U.S.C. § 371 of PCT Application No. PCT/KR2019/012425, filed Sep. 24, 2019, which claims priority to Korean Patent Application No. 10-2018-0150743, filed Nov. 29, 2018, whose entire disclosures are hereby incorporated by reference.

TECHNICAL FIELD

The present disclosure relates to an air conditioner, and more particularly, to an air conditioner capable of continuously performing heating operation while dividing and defrosting an outdoor heat exchanger in the case of heating operation.

BACKGROUND ART

In general, an air conditioner is an apparatus for cooling or heating a room using a cooling cycle including a compressor, an outdoor heat exchanger, an expansion mechanism, and an indoor heat exchanger.

The air conditioner may be composed of a cooler that cools the room, or may be composed of an air conditioner (that is, a heat pump) for air cooling and heating which cools the room or heats the room.

When the air conditioner is composed of an air conditioner for cooling and heating, the air conditioner includes a cooling/heating switching valve that changes a flow direction of refrigerant compressed in the compressor according to a cooling operation and a heating operation.

In the air conditioner, the refrigerant compressed in the compressor passes through the cooling/heating switching valve and flows into the outdoor heat exchanger during the cooling operation, and the outdoor heat exchanger functions as a condenser. Furthermore, the refrigerant condensed in the outdoor heat exchanger expands in the expansion mechanism, and is then introduced into the indoor heat exchanger. The indoor heat exchanger functions as an evaporator, and the refrigerant evaporated in the indoor heat exchanger is again introduced into the compressor by passing through the cooling/heating switching valve.

On the other hand, in the air conditioner, the refrigerant compressed in the compressor passes through the cooling/heating switching valve and flows into the indoor heat exchanger during the heating operation, and the indoor heat exchanger functions as a condenser. Furthermore, the refrigerant condensed in the indoor heat exchanger expands in the expansion mechanism, and is then introduced into the outdoor heat exchanger. The outdoor heat exchanger functions as an evaporator, and the refrigerant evaporated in the outdoor heat exchanger is again introduced into the compressor by passing through the cooling/heating switching valve.

In the air conditioner as described above, condensed water is formed on the surface of the outdoor heat exchanger that functions as an evaporator during the heating operation, and when an outside temperature is low, the condensed water on the surface of the outdoor heat exchanger freezes and frost may be adhered to the outdoor heat exchanger. The frost adhered to the outdoor heat exchanger disturbs the smooth flow and heat exchange of outdoor air, thus causing a decrease in indoor heating performance.

In order to remove the frost on the surface of the outdoor heat exchanger, the air conditioner may stop the heating operation during the heating operation, perform a separate defrost operation that switches the flow direction of the refrigerant as in the cooling operation, and again start the heating operation after the defrost operation is performed. However, the air conditioner as described above has disadvantages that it is impossible to heat a room while the defrost operation is be performed (that is, during the defrost operation) and may provide inconvenience to a user. Recently, instead of defrosting the entire outdoor heat exchanger at the same time, the technology of performing defrost by dividing the outdoor heat exchanger is increasingly developed, and an example of such an air conditioner is disclosed in Korean Patent Registration No. 10-1572845 (published on Nov. 30, 2015).

In Korean Patent Registration No. 10-1737365 (announced on May 20, 2017), an outdoor heat exchanger may include a first heat exchanger and a second heat exchanger, and the first heat exchanger and the second heat exchanger is selectively defrosted.

DISCLOSURE

Technical Problem

The present disclosure provides an air conditioner capable of minimizing a total defrost time by minimizing the amount of frost adhered to the lowermost heat exchange unit upon partial defrost of an outdoor heat exchanger.

Technical Solution

According to an embodiment of the present disclosure, an air conditioner includes an outdoor heat exchanger in which N heat exchange units are spaced apart from one another sequentially in a vertical direction, a first heat exchange unit is located on a top side, an N-th heat exchange unit is located on a bottom side, and at least one heat exchange is located between the first heat exchange unit and the N-th heat exchange unit; N expansion valves respectively connected to the N heat exchange units; N hot gas pipes respectively connected to the N heat exchange units; N hot gas valves respectively installed in the N hot gas pipes; and a controller configured to control the N expansion valves and the N hot gas valves to defrost the N heat exchange units, wherein the controller is configured to defrost the N-th heat exchange unit first, then defrost the first heat exchange unit, and defrost the heat exchange units located under the first heat exchange unit sequentially from a second heat exchange unit to the N-th heat exchange unit after defrosting the first heat exchange unit.

The defrost of each of the N heat exchange units may be completed when a set temperature is maintained for a defrost completion time after the defrost is started, and may be forcibly finished when a compulsory finish time set to be longer than the defrost completion time has elapsed after the defrost is started.

The defrost completion times of the N heat exchange units may be different from each other.

The defrost completion times of the N heat exchange units may be set to increase as it goes toward the lower side of the N heat exchange units.

The compulsory finish times of the N heat exchange units may be different from each other.

The compulsory finish times of the N heat exchange units may be set to increase as it goes toward the lower side of the N heat exchange units.

The controller may be configured to defrost a pair of heat exchange units between defrosts of a pair of adjacent heat exchange units among the N heat exchange units.

Advantageous Effects

According to the embodiment of the present disclosure, when the outdoor heat exchanger is defrosted, it is possible to minimizing the total amount of frost adhered to the entire lowermost heat exchange unit and minimize the time required to complete defrost of the entire outdoor heat exchanger by minimizing the thickness of frost formed on the lowermost heat exchange unit located at the lowermost side.

In addition, the defrost time of the heat exchange unit located at the lower side of a pair of adjacent heat exchange units may be longer than the defrost time of the heat exchange unit located at the upper side, so that the heat exchange units can be defrosted evenly as a whole.

In addition, simultaneous defrost to remove frost existing a portion between the pair of adjacent heat exchange units is performed between the defrost of the heat exchange unit located at the upper side and the defrost of the heat exchange unit located at the lower side, thus removing frost existing the portion between the heat exchange units with highly reliability.

MODE FOR INVENTION

Hereinafter, specific embodiments of the present disclosure will be described in detail with reference to the drawings.

Figure 1:
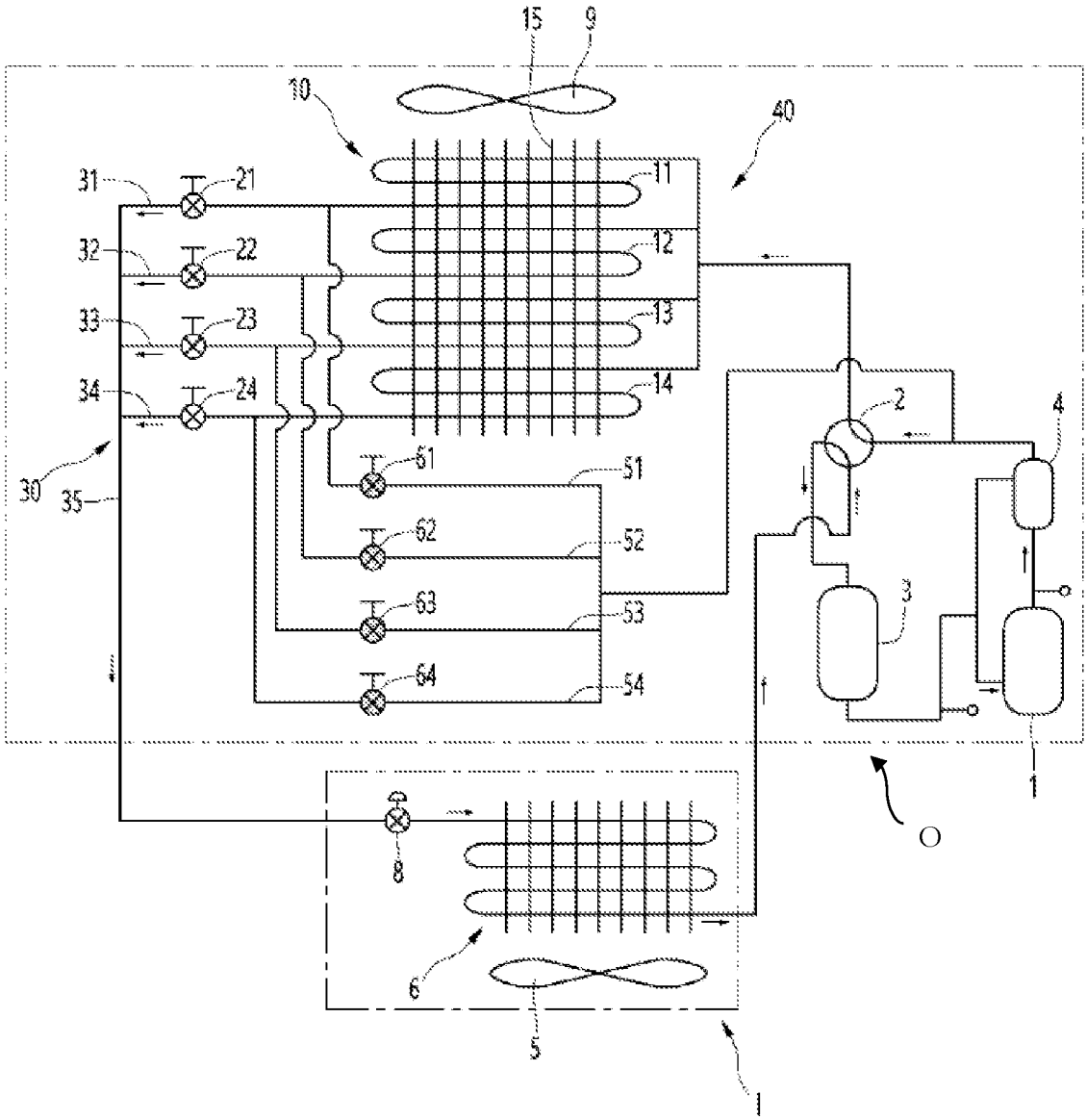
FIG. 1 is a diagram showing a flow of refrigerant in a cooling operation of an air conditioner according to an embodiment of the present disclosure.
Figure 2:
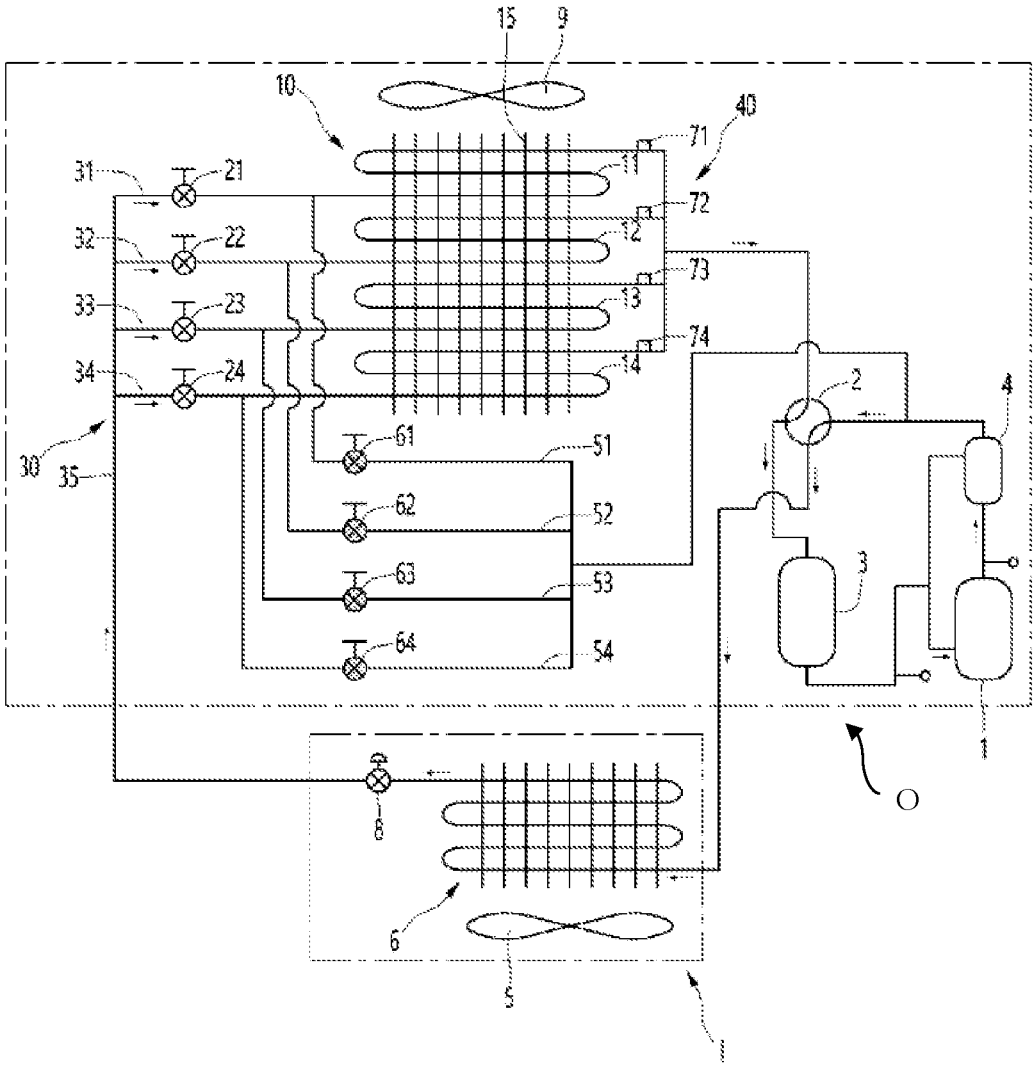
FIG. 2 is a diagram showing a flow of refrigerant in a general heating operation of an air conditioner according to an embodiment of the present disclosure.
Figure 3:
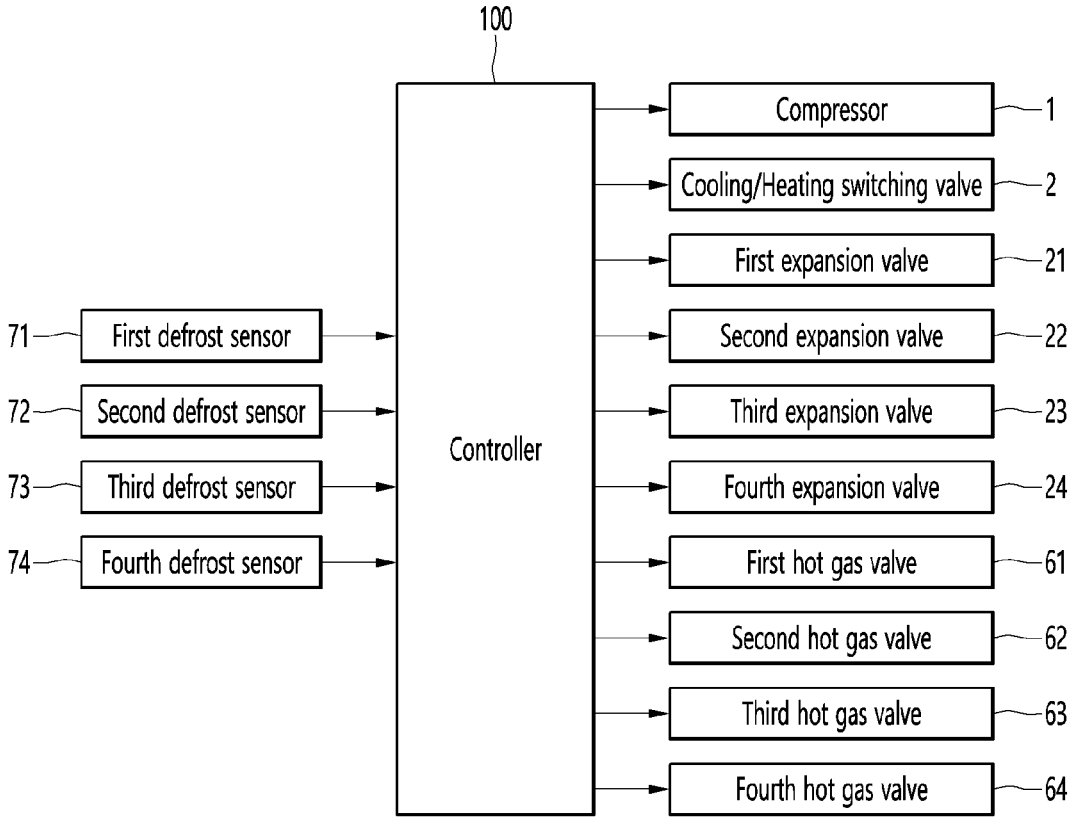
FIG. 3 is a control block diagram of an air conditioner according to an embodiment of the present disclosure.

FIG. 1 is a diagram showing a flow of refrigerant in a cooling operation of an air conditioner according to an embodiment of the present disclosure, FIG. 2 is a diagram showing a flow of refrigerant in a general heating operation of an air conditioner according to an embodiment of the present disclosure, and FIG. 3 is a control block diagram of an air conditioner according to an embodiment of the present disclosure.

An air conditioner may include a compressor 1, a cooling/heating switching valve 2, an indoor fan 5, an indoor heat exchanger (or indoor unit) 6, an outdoor fan 9, and an outdoor heat exchanger (or outdoor unit) 10.

The compressor 1 may be composed of an inverter compressor, and an input frequency thereof may be changed according to a load of the indoor heat exchanger 6.

A compressor suction flow path and a compressor discharge flow path may be connected to the compressor 1.

The air conditioner may further include an accumulator 3 installed in a compressor suction line to receive liquid refrigerant. The compressor suction line may include an accumulator suction line connected to the cooling/heating switching valve 2 and the accumulator 3 and an accumulator outlet line connected to the accumulator 3 and the compressor 1.

The air conditioner may further include an oil separator 4 installed in the compressor discharge line and separating oil among refrigerant discharged from the compressor 1 to guide the oil the compressor suction line. The compressor discharge line may include an oil separator suction line connected to the compressor 1 and the oil separator 4 and an oil separator outlet line connected to the oil separator 4 and the cooling/heating switching valve 2.

The cooling/heating switching valve 2 may be connected to the compressor 1 through the compressor suction flow path and the compressor discharge flow path. The cooling/heating switching valve 2 may be connected to an accumulator suction line among compressor suction lines. The cooling/heating switching valve 2 may be connected to an oil separator outlet line among compressor discharge lines.

The cooling/heating switching valve 2 may be connected to the outdoor heat exchanger 10 and an outdoor heat exchanger connection line. In addition, the cooling/heating switching valve 2 may be connected to the indoor heat exchanger 6 and an engine.

The cooling/heating switching valve 2 may guide the refrigerant flowing from the oil separator 4 to the outdoor heat exchanger connection line as shown in FIG. 1 and guide refrigerant flowing from the engine to the accumulator 3 in a cooling operation.

The cooling/heating switching valve 2 may guide the refrigerant flowing from the oil separator 4 to the engine and guide refrigerant flowing from the outdoor heat exchanger connection line to the accumulator 3 in a heating operation.

The indoor fan 5 may be installed to blow indoor air to the indoor heat exchanger 6.

The indoor fan 5, the indoor heat exchanger 6, and the indoor expansion mechanism 8 may be disposed in an indoor unit "I".

Although a configuration in which one indoor unit "I" is connected to an outdoor unit through the engine and the liquid pipe is illustrated in FIGS. 1 and 2 for convenience, the present embodiment is not limited to a configuration including one indoor unit I, and a plurality of indoor units may be connected to the outdoor unit "O" through the liquid pipe and the engine.

The indoor expansion mechanism 8 may be connected to N expansion valves 21, 22, 23, and 24, which will be described later through liquid pipes. The indoor expansion mechanism 8 may expand refrigerant flowing into the indoor heat exchanger 6 in a heating operation.

The outdoor fan 9 may blow outdoor air to the outdoor heat exchanger 10.

The compressor 1, the cooling/heating switching valve 2, the accumulator 3, the oil separator 4, the outdoor fan 9, and the outdoor heat exchanger 10 may be disposed in the outdoor unit "O".

The outdoor heat exchanger 10 may include a plurality of heat exchange units (or heat exchanges) 11, 12, 13, and 14 which perform heat exchange between outdoor air (hereinafter referred to as outside air) and refrigerant. In addition, the outdoor heat exchanger 10 may further include a pin 15 connected to the plurality of heat exchange units 11, 12, 13, and 14.

The outdoor heat exchanger 10 may be connected to the cooling/heating switching valve 2 by an outdoor heat exchanger connection line.

The outdoor heat exchanger 10 may function as a condenser in which refrigerant is condensed in a cooling operation. The outdoor heat exchanger 10 may function as an evaporator in which refrigerant is evaporated in a heating operation. In the outdoor heat exchanger 10, some of the plurality of heat exchange units 11, 12, 13, and 14 may function as an evaporator during heating operation, and the remaining heat exchange units may be defrosted by hot gas.

The heating operation may be classified into a general heating operation (that is, non-defrost heating operation) in which the plurality of heat exchange units 11, 12, 13, and 14 all function as evaporators, and a defrost heating operation in which the plurality of heat exchange units 11, 12, 13, and 14 are sequentially defrosted in a specific order.

Here, the defrost heating operation refers to an operation in which some of the plurality of heat exchange units 11, 12, 13, and 14 functions as evaporators, and the remaining heat exchange units are defrosted, and is different from the general heating operation in which the plurality of heat exchange units 11, 12, 13, and 14 all function as evaporators.

In a case where a user inputs the heating operation, the air conditioner may be operated in the defrost heating operation when a defrost entry condition is satisfied while being operated in the general heating operation and the air conditioner may be operated again in the general heating operation when a defrost release condition is satisfied while being operated in the defrost heating operation.

Hereinafter, the heating operation in which all of the plurality of heat exchange units 11, 12, 13, and 14 functions as evaporators will be referred to as a general heating operation, and the heating operation in which the plurality of heat exchange units 11, 12, 13, and 14 are sequentially defrosted in a specific order will be referred to as a defrost heating operation.

On the other hand, the common portion of the general heating operation and the defrost heating operation will be described as a heating operation, and when the general heating operation and the defrost heating operation are separately described, the general heating operation and the defrost heating operation will be described separately.

The refrigerant flow in the general heating operation is illustrated in FIG. 2, and the refrigerant flow in the defrost heating operation is illustrated in FIGS. 4 to 7.

On the other hand, the cooling/heating switching valve 2 may be controlled in the same way during the general heating operation and the defrost heating operation. That is, the cooling/heating switching valve 2 may guide refrigerant flowing in the oil separator 4 to the indoor heat exchanger 6 through the engine and guide the refrigerant, which flows from the outdoor heat exchanger 10 to the outdoor heat exchanger connection line, to the accumulator 3, as shown in FIGS. 2 to 7 respectively during the general heating operation and the defrost heating operation.

Hereinafter, the outdoor heat exchanger 10 will be described in detail as follows.

The outdoor heat exchanger 10 may be composed of a combination of a plurality of heat exchange units (hereinafter referred to as "N heat exchange units"), and the N heat exchange units 11, 12, 13 and 14 may be connected in parallel to refrigerant flow paths.

The refrigerant flowing into the outdoor heat exchanger 10 may be distributed to and pass through N heat exchange units 11, 12, 13 and 14, and refrigerant that has passed through the N heat exchange units 11, 12, 13 and 14 may flow after being joined.

A first connection flow path 30 and a second connection flow path 40 may be connected to the N heat exchange units 11, 12, 13, and 14. The first connection flow path 30 and the second connection flow path 40 may be disposed before and after the N heat exchange units 11, 12, 13, and 14 in the refrigerant flow direction, respectively.

Referring to the heating operation, the first connection flow path 30 may be a branch flow path through which refrigerant is distributed into the N heat exchange units 11, 12, 13, and 14, and the second connection flow path 40 may be a joining flow path in which refrigerants passing through the N heat exchange units 11, 12, 13, and 14 are joined.

Conversely, referring to the cooling operation, the first connection flow path 30 may be a joining flow path in which refrigerants passing through N heat exchange units 11, 12, 13, 14 are joined. The second connection flow path 40 may be a branch flow path through which the refrigerant is distributed into the N heat exchange units 11, 12, 13, and 14.

The first connection flow path 30 may be connected to the N heat exchange units 11, 12, 13, and 14 individually and may include a header or a distributor.

The second connection flow path 40 may be connected to the N heat exchange units 11, 12, 13, 14 individually and may include a header or a distributor.

The N heat exchange units 11, 12, 13 and 14 constituting the outdoor heat exchanger 10 may be spaced apart from one another sequentially in the longitudinal direction.

Among the N heat exchange units 11, 12, 13 and 14, the heat exchange unit located at the uppermost side may be defined as the first heat exchange unit 11, the heat exchange unit located at the lowermost side may be the N-th heat exchange unit 14, and the outdoor heat exchanger 10 may include at least one heat exchange unit located between the first heat exchange unit 11 and the N-th heat exchange unit 14.

Here, each of the plurality of heat exchange units may include a plurality of refrigerant tubes connected in series to one another in the refrigerant flow direction, and may include a plurality of refrigerant tubes connected in parallel to one another in the refrigerant flow direction. The plurality of refrigerant tubes constituting the heat exchange unit may be arranged in such a manner that one refrigerant tube is disposed higher or lower than the other refrigerant tube, but a plurality of refrigerant tubes connected in series or in parallel may constitute a single heat exchange unit.

In the outdoor heat exchanger 10, the second heat exchange unit 12, the third heat exchange unit 13, and the N-th heat exchange unit 14 may be defined as it goes downward from the first heat exchange unit 11.

In a case where N is 3, when the outdoor heat exchanger 10 includes three heat exchange units sequentially spaced in the longitudinal direction, a heat exchange unit located at the uppermost side may be the first heat exchange unit 11, a heat exchange unit closest to the heat exchange unit 11 may be the second heat exchange unit 12, and a heat exchange unit located at the lowermost side among the three heat exchange units may be the N-th heat exchange unit.

In a case where N is 4, when the outdoor heat exchanger 10 includes four heat exchange units sequentially spaced in the longitudinal direction, a heat exchange unit located at the uppermost side may be the first heat exchange unit 11, a heat exchange unit closest to the heat exchange unit 11 may be the second heat exchange unit 12, a heat exchange unit closest to the second heat exchange unit 12 under the second heat exchange unit 12 may be the third heat exchange unit 13, and a heat exchange unit located at the lowermost side among the four heat exchange units may be the N-th heat exchange unit.

The air conditioner may include N expansion valves 21, 22, 23, and 24 respectively connected to the N heat exchange units 11, 12, 13, and 14, and the heat exchange unit may be an expansion valve in one-to-one correspondence. A first expansion valve 21 may be connected to the first heat exchange unit 11, a second expansion valve 22 may be connected to the second heat exchange unit 12, a third heat exchange unit 13 may be connected to the third heat exchange unit 13, and an N-th expansion valve 24 may be connected to the N-th heat exchange unit 14.

The N expansion valves 21, 22, 23, and 24 may be installed in the first connection flow path 30 in the refrigerant flow direction in the heating operation. The first connection flow path 30 may include N flow paths 31, 32, 33, and 34 connected to the N heat exchange units 11, 12, 13, and 14 and one common flow path 35 connected to the N flow paths. The N flow paths 31, 32, 33, and 34 are connected to the first heat exchange unit 11, and the first flow path 31 provided with the first expansion valve 21, the second flow path 32 connected to the second heat exchange unit 12 and provided with the second expansion valve 22, the third flow path 33 connected to the third heat exchange unit 13 and provided with the third expansion valve 23, the N-th flow path 34 connected to the N-th heat exchange unit 14 and provided with the N-th expansion valve 24, the first flow path 31, the second flow path 32, the third flow path 33, and the N-th flow path 34 are connected to the common flow path 35.

The air conditioner may further include N hot gas pipes 51, 52, 53, and 54 connected to the N heat exchange units 11, 12, 13, and 14, respectively. The hot gas pipes may in one-to-one correspondence with the heat exchange units.

The hot gas pipe may be connected to the heat exchange unit through the first connection flow path 30, and the N hot gas pipes 51, 52, 53, and 54 may include the first hot gas pipe 51 connected between the first expansion valve 21 and the first heat exchange unit 11 among the first flow path 31, the second hot gas pipe 52 connected between the second expansion valve 22 and the second heat exchange unit 12 among the second flow path 32, the third hot gas pipe 53 connected between the third expansion valve 23 and the third heat exchange unit 13 among the third flow path 33, and the N-th hot gas pipe 54 connected between the N-th expansion valve 24 and the N-th heat exchange unit 14 among the N-th flow path 34.

The hot gas pipe may include a common hot gas pipe 55 to which the first hot gas pipe 51, the second hot gas pipe 52, the third hot gas pipe 53, and the N-th hot gas pipe 54 are connected, and the common hot gas pipe 55 may be connected to a compressor discharge flow path, in particular, the oil separator outlet line.

In the air conditioner, the N hot gas valves 61, 62, 63, and 64 respectively installed in the N hot gas pipes may have one-to-one correspondence with heat exchange units.

The hot gas valves may include a first hot gas valve 61 installed in the first hot gas pipe 51, a second hot gas valve 62 installed in the second hot gas pipe 52, a third hot gas pipe 63 installed in the third hot gas pipe 53, and an N hot gas valve 64 installed in the N-th hot gas pipe 54.

The hot gas valve may be in one-to-one correspondence with the expansion valve, and may be opened/closed inversely to the expansion valve. In the heating operation, when the first expansion valve 21 is closed, the first hot gas valve 61 may be opened, and conversely, when the opening degree is adjusted to the opening degree at which the first expansion valve 21 expands the refrigerant, the first hot gas valve 61 may be closed. Since the opening/closing of the second hot gas valve 62, the third hot gas valve 63, and the N-th hot gas valve 63 is the same principle as the first hot gas valve 61, detailed description of each example is omitted to avoid duplicate description.

The air conditioner may include at least one defrost sensor that senses the temperature of the outdoor heat exchanger 10. Of course, it is possible that a single defrost sensor is installed in the second connection flow path and detect the temperature at the outlet side of the outdoor heat exchanger 10 during heating operation, and a plurality of defrost sensors are installed in the heat exchange units 11, 12, 13 and 14.

When the temperature of each of the plurality of heat exchange units 11, 12, 13, and 14 is sensed, it is possible to determine whether the defrost of each of the heat exchange units 11, 12, 13 and 14 is completed with high reliability, and in this case, the plurality of defrost sensors 71, 72, 73, and 74 may include the first defrost sensor 71 installed in the first heat exchange unit 11, the second defrost sensor 72 installed in the second heat exchange unit 12, the third defrost sensor 73 installed in the third heat exchange unit 13, and the fourth defrost sensor 74 installed in the N-th heat exchange unit 14.

Figure 4:
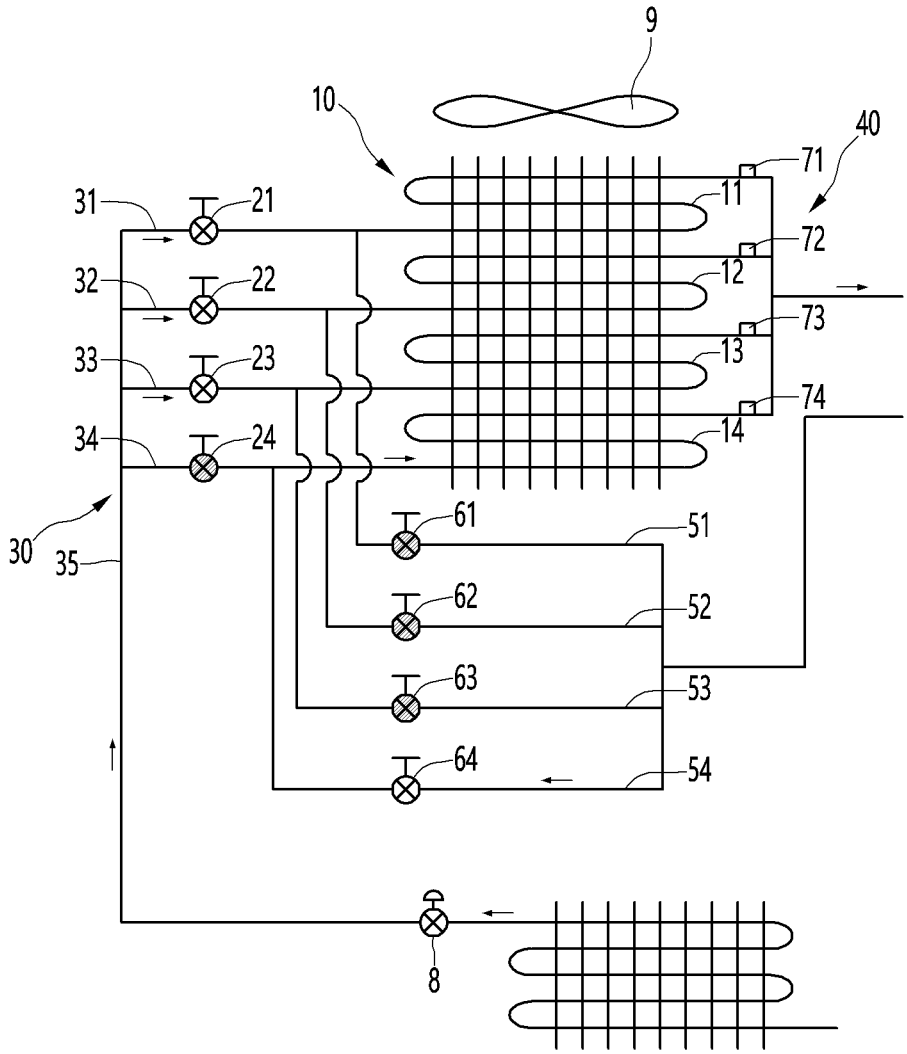
FIG. 4 is a diagram showing a flow of refrigerant when an N-th heat exchange unit is defrosted in a defrost heating operation of an air conditioner according to an embodiment of the present disclosure.
Figure 5:
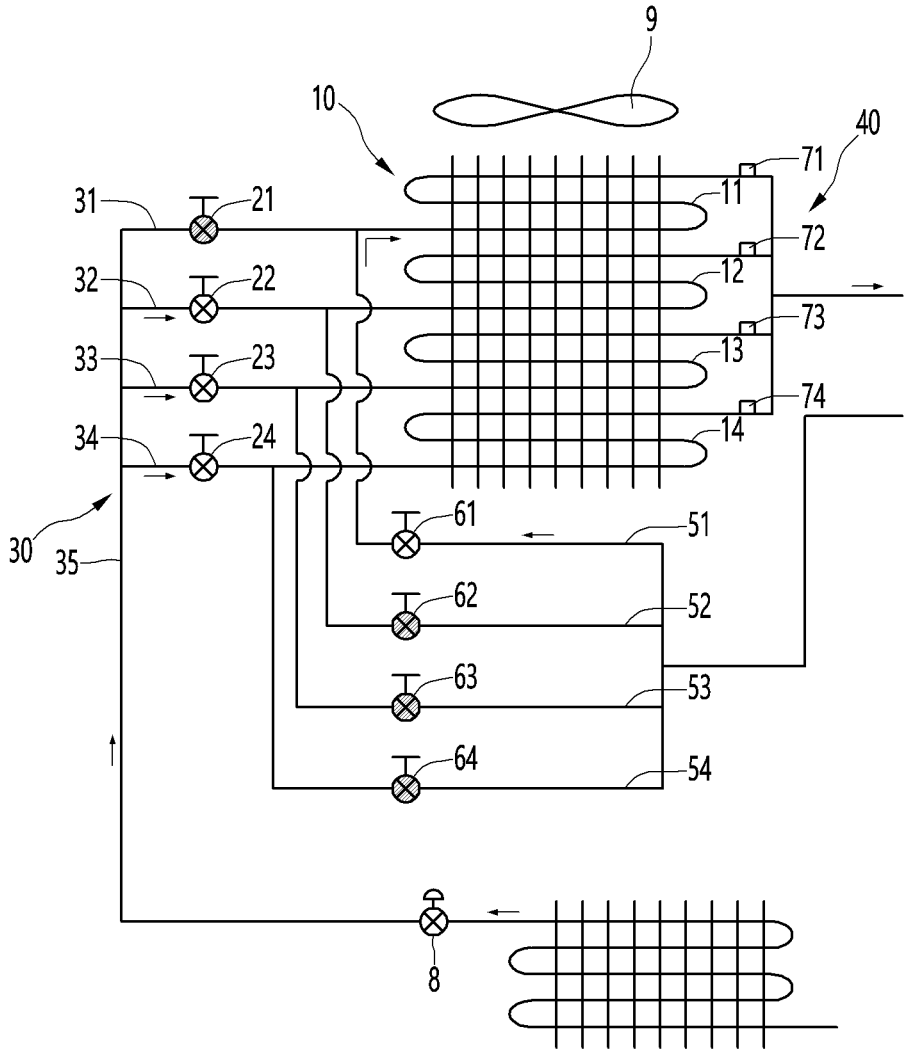
FIG. 5 is a diagram showing a flow of refrigerant when a first heat exchange unit is defrosted in a defrost heating operation of an air conditioner according to an embodiment of the present disclosure.
Figure 6:
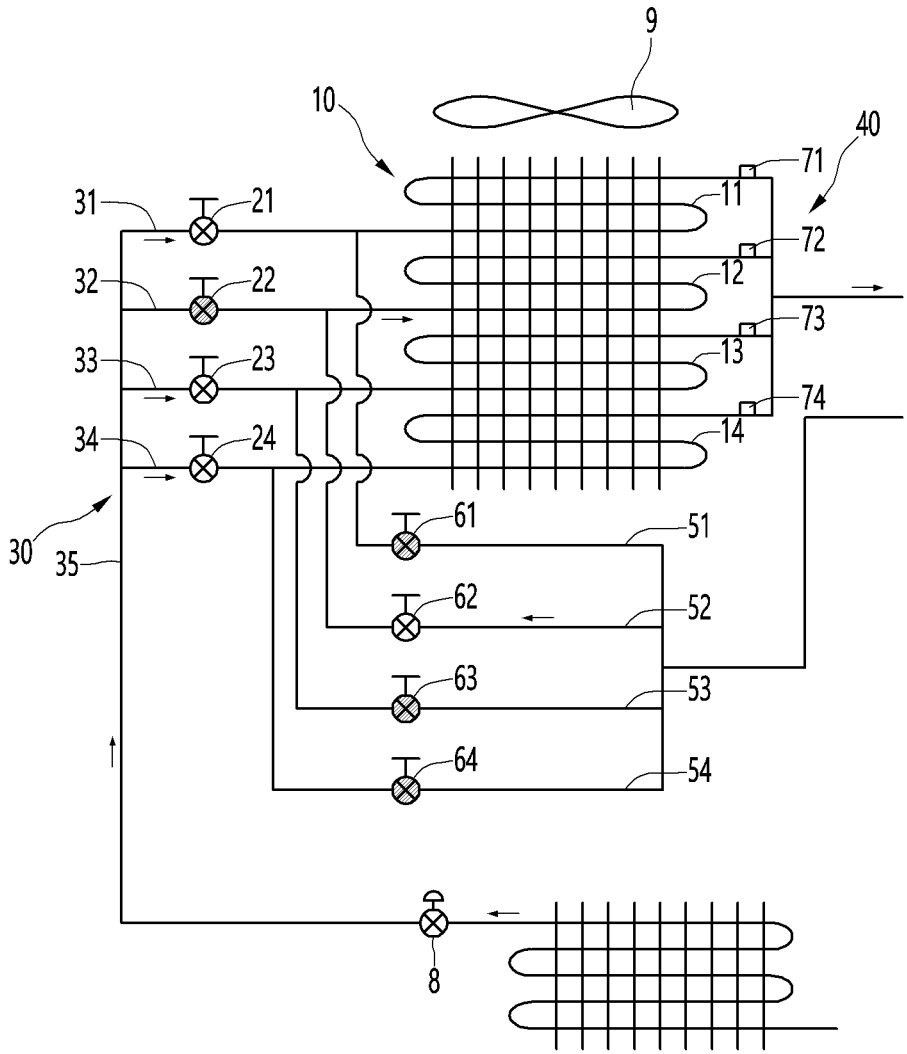
FIG. 6 is a diagram showing a flow of refrigerant when a second heat exchange unit is defrosted in a defrost heating operation of an air conditioner according to an embodiment of the present disclosure.
Figure 7:
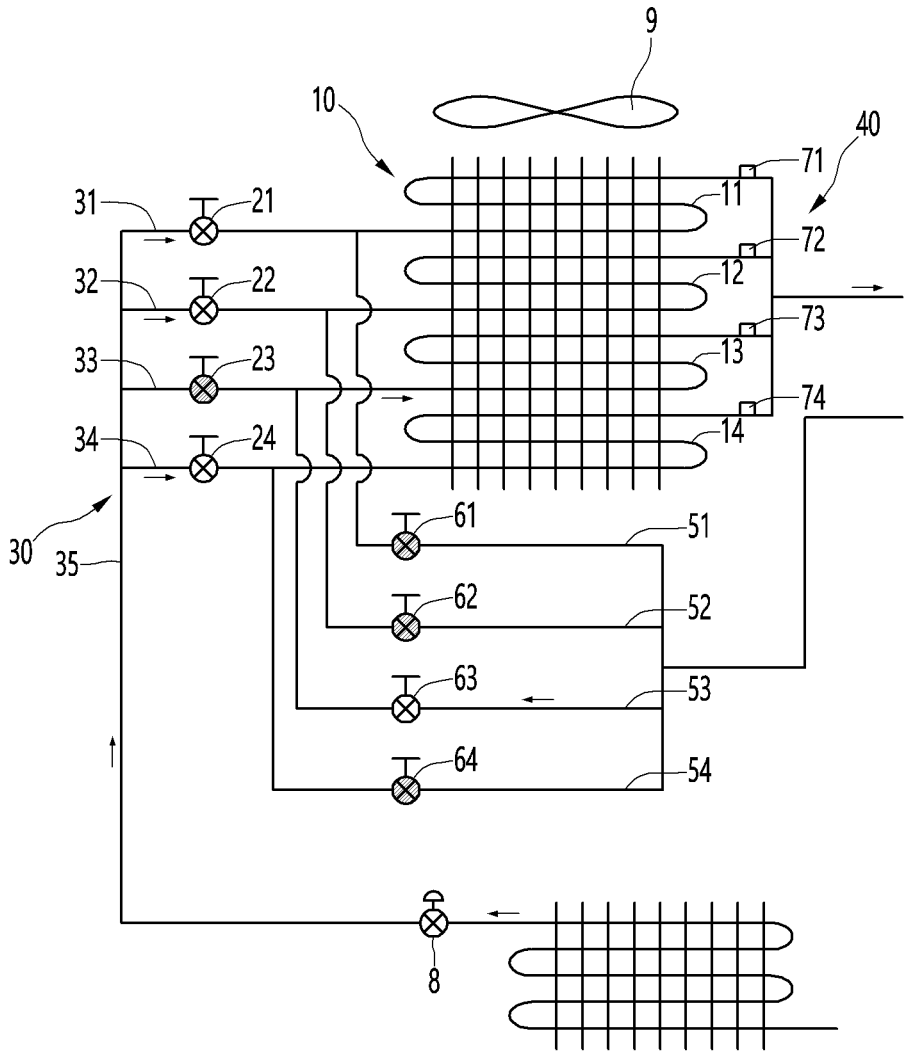
FIG. 7 is a diagram showing a flow of refrigerant when a third heat exchange unit is defrosted in a defrost heating operation of an air conditioner according to an embodiment of the present disclosure.
Figure 8:
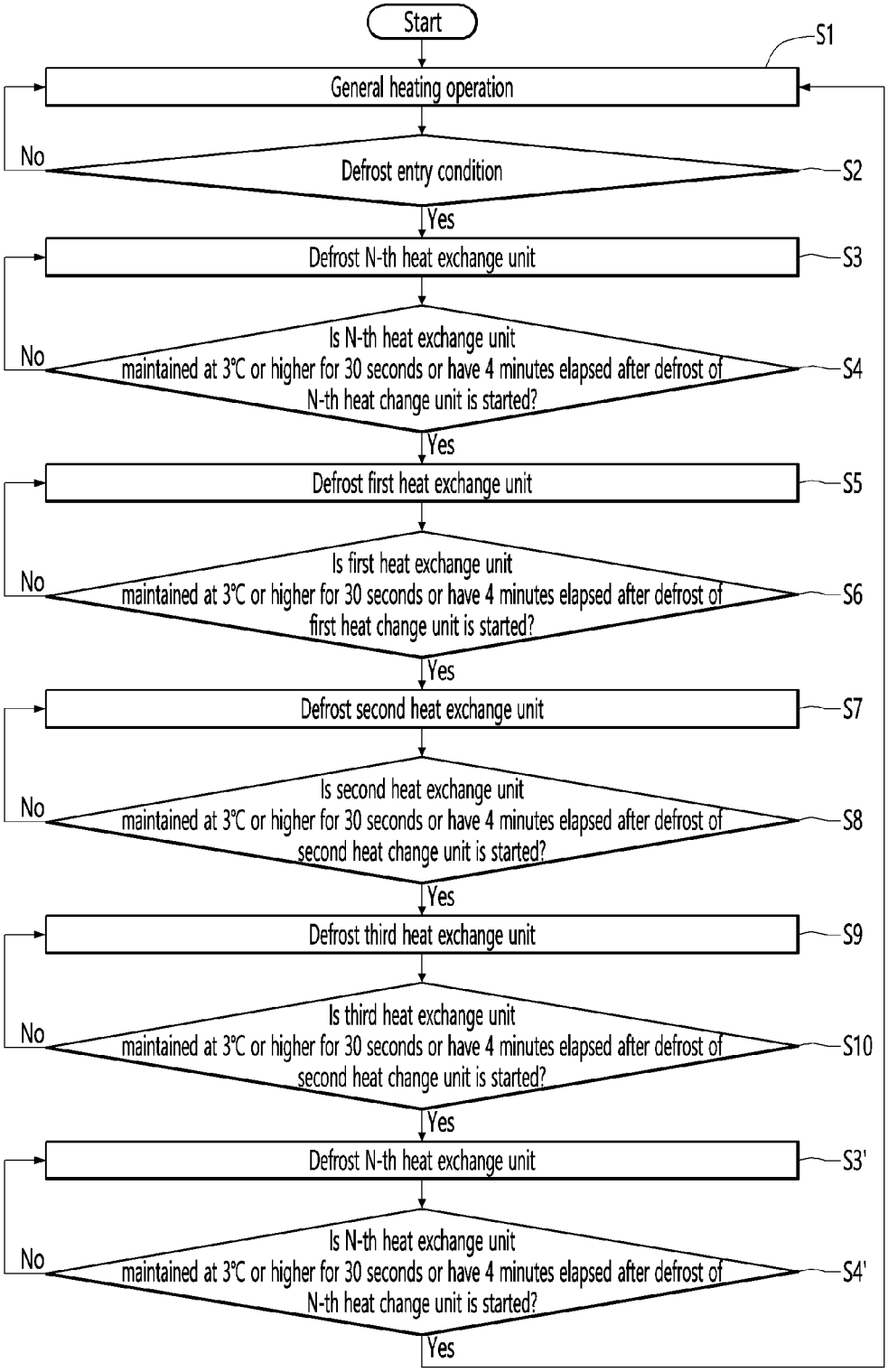
FIG. 8 is a flowchart of a method of operating an air conditioner according to an embodiment of the present disclosure.

FIG. 4 is a diagram showing a flow of refrigerant when an N-th heat exchange unit is defrosted in a defrost heating operation of an air conditioner according to an embodiment of the present disclosure, FIG. 5 is a diagram showing a flow of refrigerant when a first heat exchange unit is defrosted in a defrost heating operation of an air conditioner according to an embodiment of the present disclosure, FIG. 6 is a diagram showing a flow of refrigerant when a second heat exchange unit is defrosted in a defrost heating operation of an air conditioner according to an embodiment of the present disclosure, and FIG. 7 is a diagram showing a flow of refrigerant when a third heat exchange unit is defrosted in a defrost heating operation of an air conditioner according to an embodiment of the present disclosure. Furthermore, FIG. 8 is a flowchart of a method of operating an air conditioner according to an embodiment of the present disclosure.

The air conditioner may include a controller 100 that controls N expansion valves and N hot gas valves 61, 62, 63, and 64 to deforest the N heat exchange units 11, 12, 13, and 14 during a heating operation.

The controller 100 preferably defrosts the N heat exchange units 11, 12, 13 and 14 in the order for defrosting the entire outdoor heat exchanger 1 with high reliability while minimizing the total defrosting time of the N heat exchange units 11, 12, 13, and 14.

The controller 100 first defrosts the N-th heat exchange unit 14 located at the lowermost of the N heat exchange units 11, 12, 13 and 14, then the first heat exchange unit located at the uppermost side and sequentially defrosts the heat exchange units 12, 13, and 14 located under the first heat exchange unit 12 from the second heat exchange unit 12 to the N-th heat exchange unit 14.

That is, the controller 100 may defrost the N heat exchange units 11, 12, 13, and 14 in the order of the N-th heat exchange unit 14, the first heat exchange unit 11, the second heat exchange unit 12, the third heat exchange unit 13 and the N-th heat exchange unit 14. In this case, the controller 100 may perform N+1 times of defrost to defrost the N heat exchange units 11, 12, 13, and 14.

When N is 4, the controller 100 may defrost the fourth heat exchanger 14, the first heat exchange unit 11, the second heat exchange unit 12, the third heat exchange unit 13, and the fourth heat exchange unit 14 in the order thereof, and in this case, the fourth heat exchange unit 14 may be defrosted a total of two times.

On the other hand, it is possible that the controller 100 defrosts the N heat exchange units 11, 12, 13, and 14 in the order of the first heat exchange unit 11, the second heat exchange unit 12, the third heat exchange unit 13 and the N-th heat exchange unit 14.

For convenience of description, description will be given under assumption that the outdoor heat exchanger 1 includes four heat exchange units.

The controller 100 may perform defrost in the order of the heat exchange unit 11, the second heat exchange unit 12, the third heat exchange unit 13, and the fourth heat exchange unit 14 in a state where a single layer of frost is adhered to each of the first heat exchange unit 11, the second heat exchange unit 12, the third heat exchange unit 13 and the fourth heat exchange unit 14.

In this case, when the first heat exchange unit 11 is defrosted, condensed water flowing down during the defrost of the first heat exchange unit 11 is again adhered to each of the second heat exchange unit 12, the third heat exchange unit 13, and the fourth heat exchange unit 14, thus two layers of frost being formed.

Furthermore, when the second heat exchange unit 11 is defrosted, condensed water flowing down during the defrost of the second heat exchange unit 11 is again adhered to each of the third heat exchange unit 13, and the fourth heat exchange unit 14, thus three layers of frost being formed.

Then, when the third heat exchange unit 13 is defrosted, condensed water flowing down during the defrost of the third heat exchange unit 11 is again adhered to the fourth heat exchange unit 14, thus four layers of frost being formed.

Since, when defrost is performed in the order of the first heat exchange unit 11, the second heat exchange unit 12, the third heat exchange unit 13 and the fourth heat exchange unit 14, the fourth heat exchange unit 14 has four layers of frost, defrost of the fourth heat exchange unit 14 may take a long time to defrost the fourth heat exchange unit 14. On the other hand, when a compulsory finish time of the fourth heat exchange unit 14 is reached after the defrost of the fourth heat exchange unit 14 is started and the defrost of the fourth heat exchange unit 14 is forcibly finished, in the outdoor heat exchanger 1, the defrost heating operation may be terminated when the compulsory finish time is reached in a state where the fourth heat exchange unit 14 is not sufficiently defrosted.

That is, when defrost is performed in the order of the first heat exchange unit 11, the second heat exchange unit 12, the third heat exchange unit 13 and the fourth heat exchange unit 14, the total defrost time may be long, or the fourth heat exchange unit 14 may not be sufficiently defrosted.

On the other hand, in the present embodiment, the controller 100 may perform defrost in the order of the fourth heat exchange unit 14, the heat exchange unit 11, the second heat exchange unit 12, the third heat exchange unit 13, and the fourth heat exchange unit 14 in a state where frost of a single layer is adhered to each of the first heat exchange unit 11, the second heat exchange unit 12, the third heat exchange unit 13 and the fourth heat exchange unit 14.

In this case, when the fourth heat exchange unit 14 is defrosted, condensed water flowing down from the fourth heat exchange unit 14 may fall to the lower side of the outdoor heat exchanger 1, and when the fourth heat exchange unit 14 is defrosted, the first heat exchange unit 11, the second heat exchange unit 12 and the third heat exchange unit 13 are in a state where a single layer of frost is formed, but the fourth heat exchange unit may be in a state where frost is removed.

Subsequently, when the first heat exchange unit 11 is defrosted, condensed water flowing down during defrost of the first heat exchange unit 11 is again adhered to the second heat exchange unit 12, the third heat exchange unit 13, and the fourth heat exchange unit 14 individually, and the second heat exchange unit 12 and the third heat exchange unit 13 have total two layers of frost, but a single layer of frost is adhered to the fourth heat exchange unit 14.

Then, when the second heat exchange unit 12 is defrosted, condensed water flowing down during defrost of the second heat exchange unit 11 is again adhered to the third heat exchange unit 13 and the fourth heat exchange unit 14 individually, and the third heat exchange unit 13 has total three layers of frost, but total two layers of frost is adhered to the fourth heat exchange unit 14.

Furthermore, when the third heat exchange unit 13 is defrosted, condensed water flowing down during the defrost of the third heat exchange unit 11 is again adhered to the fourth heat exchange unit 14, thus total three layers of frost being formed.

As in the present embodiment, when the fourth heat exchange unit 14, the first heat exchange unit 11, the second heat exchange unit 12, the third heat exchange unit 13 and the fourth heat exchange unit 14 are defrosted in the order thereof, the fourth heat exchange unit 14 is defrosted in a state where three layers of frost is formed, and the time during which frost is formed is shortened and the fourth heat exchange unit 14 is defrosted with high reliability compared to a case where total four layers of frost are formed on the fourth heat exchange unit 14.

Due to the nature of the defrost, the sum of the time of forming frost in a single layer and the time of forming frost in a total of three layers is shorter than the time of forming frost in a total of four layers, and when defrosting the N heat exchange units 11, 12, 13, and 14 in the same order as in the present embodiment, the total time of defrosting the outdoor heat exchanger 1 entirely may be shortened, and the entire outdoor heat exchanger 1 may be defrosted with higher reliability.

On the other hand, the defrost of each of the N heat exchange units 11, 12, 13 and 14 is completed when a set temperature TR is maintained for the defrost completion time TS after the defrost is started, or is finished when the compulsory finish time TM set longer than the defrost completion time TS has elapsed after the defrost is started.

Here, the set temperature TR is a room temperature at which it may be determined that defrost of each heat exchange unit is completed, and may be a preset temperature, for example, −3° C.

In addition, the defrost completion time TS is a room temperature at which it may be determined that defrost of each heat exchange unit is completed, and may be a reference temperature set to finish defrost of the heat exchange unit.

The defrost completion times TS of the N heat exchange units 11, 12, 13, and 14 may be equal to each other. For example, the defrost completion time TM of the N heat exchange units 11, 12, 13, and 14 may be equally set to 30 seconds.

The defrost completion times TS of the N heat exchange units 11, 12, 13, and 14 may be different from each other. The defrost completion times TS of the N heat exchange units 11, 12, 13, and 14 may be set such that the defrost completion time of the first heat exchange unit 11 located at the uppermost side is the shortest. The defrost completion times TM of the N heat exchange units 11, 12, 13, and 14 may be set such that the defrost completion time of the N-th heat exchange unit 11 located at the lowermost side is the longest. In addition, the defrost completion times of the heat exchange units 12 and 13 located between the first heat exchange unit 11 and the N-th heat exchange unit 14 are longer than the defrost completion time of the first heat exchange unit 11, and is shorter than the defrost completion time of the N-th heat exchange unit 14.

The defrost completion times TS of the N heat exchange units 11, 12, 13, 14 may be set longer as it goes toward the lower direction and may be set to increase by a set time (e.g., 60 seconds)

per each heat exchange unit as it goes downward. For example, when the defrost completion time of the first heat exchange unit 11 is 30 seconds, the defrost completion time of the second heat exchange unit 12 may be 90 seconds, the defrost completion time of the third heat exchange unit 13 may be 150 seconds and the defrost completion time of the fourth heat exchange unit 13 may be 210 seconds.

In addition, the compulsory finish time TM may be a reference temperature set to forcibly finish the defrost of each heat exchange unit such that the defrost of each heat exchange unit does not last too long.

The compulsory finish times TM of the N heat exchange units 11, 12, 13, and 14 may be equal to each other. For example, the compulsory finish times TM of the N heat exchange units 11, 12, 13, and 14 may be equally set to 4 minutes.

The compulsory finish times TM of the N heat exchange units 11, 12, 13, and 14 may be different from each other. The compulsory finish times TM of the N heat exchange units 11, 12, 13, and 14 may be set such that the compulsory finish time of the first heat exchange unit 11 located at the uppermost side is the shortest. The compulsory finish times TM of the N heat exchange units 11, 12, 13, and 14 may be set such that compulsory finish time of the N-th heat exchange unit 11 located at the lowermost side is the longest. In addition, the compulsory finish times of the heat exchange units 12 and 13 located between the first heat exchange unit 11 and the N-th heat exchange unit 14 are longer than the compulsory finish time of the first heat exchange unit 11, and are shorter than the compulsory finish time of the N-th heat exchange unit 14.

The compulsory finish times TM of the N heat exchange units 11, 12, 13, 14 may be set longer as it goes toward the lower direction and may be set to increase as it goes downward. The compulsory finish times TM of the N heat exchange units 11, 12, 13, 14 may be set to increase by a set time (e.g., one minute) per each heat exchange unit as it goes downward.

For example, when the compulsory finish time of the first heat exchange unit 11 is 4 minutes, the compulsory finish time of the second heat exchange unit 12 may be 5 minutes, the compulsory finish time of the third heat exchange unit 13 may be 6 minutes and the compulsory finish time of the fourth heat exchange unit 13 may be 7 minutes.

The completion of defrost of the outdoor heat exchanger 1 may be possible in various combinations of a defrost completion time TS and a compulsory finish time TM, for example, the defrost completion times of each heat exchange units 11, 12, 13 and 14 are all the same, and the compulsory finish times TM of the heat exchange units 11, 12, 13, and 14 may be the same, which may be as shown in Table 1 below.

TABLE 1

| Defrost order | Determination of defrost completion |
|---|---|
| N-th heat exchange unit 14 | Temperature of outdoor heat exchanger is maintained at 3° C. for TS (30 seconds) or TM (4 minutes) has elapsed after defrost of fourth heat exchange unit 14 is started |
| First heat exchange unit 11 | Temperature of outdoor heat exchanger is maintained at 3° C. for TS (30 seconds) or TM (4 minutes) has elapsed after defrost of first heat exchange unit 11 is started |
| Second heat exchange unit 12 | Temperature of outdoor heat exchanger is maintained at 3° C. for TS (30 seconds) or TM (4 minutes) has elapsed after defrost of second heat exchange unit 12 is started |
| Third heat exchange unit 13 | Temperature of outdoor heat exchanger is maintained at 3° C. for TS (30 seconds) or TM (4 minutes) has elapsed after defrost of third heat exchange unit 13 is started |
| N-th heat exchange unit 14 | Temperature of outdoor heat exchanger is maintained at 3° C. for TS (30 seconds) or TM (4 minutes) has elapsed after defrost of fourth heat exchange unit 14 is started |

On the other hand, another example of the completion of defrost of the outdoor heat exchanger 1 is that the defrost completion times TS of the heat exchange units 11, 12, 13, and 14 are all different, and the compulsory finish times TM of the heat exchange units 11, 12, 13, and 14 may be all different, which may be as shown in Table 2 below.

TABLE 2

| Defrost order | Determination of defrost completion |
|---|---|
| N-th heat exchange unit 14 | Temperature of outdoor heat exchanger is maintained at 3° C. for TS (210 seconds) or TM (7 minutes) have elapsed after defrost of fourth heat exchange unit 14 is started |
| First heat exchange unit 11 | Temperature of outdoor heat exchanger is maintained at 3° C. for TS (30 seconds) or TM (4 minutes) has elapsed after defrost of first heat exchange unit 11 is started |
| Second heat exchange unit 12 | Temperature of outdoor heat exchanger is maintained at 3° C. for TS (90 seconds) or TM (5 minutes) has elapsed after defrost of second heat exchange unit 12 is started |
| Third heat exchange unit 13 | Temperature of outdoor heat exchanger is maintained at 3° C. for TS (150 seconds) or TM (6 minutes) has elapsed after defrost of third heat exchange unit 13 is started |
| N-th heat exchange unit 14 | Temperature of outdoor heat exchanger is maintained at 3° C. for TS (210 seconds) or TM (7 minutes) has elapsed after defrost of fourth heat exchange unit 14 is started |

On the other hand, as another example of the completion of defrost of the outdoor heat exchanger 1 according to the present embodiment, it is possible that the defrost completion times TS of the heat exchange units 11, 12, 13 and 14 are different from each other and the compulsory finish times of the heat exchange units 11, 12, 13, and 14 are equal to each other, or it is also possible that the defrost completion times TS of the heat exchange units 11, 12, 13 and 14 are equal to each other and the compulsory finish times of the heat exchange units 11, 12, 13, and 14 are different from each other. Meanwhile, the flowchart shown in FIG. 8 is given in a case where defrost is performed in the order of the N-th heat exchange unit 14, the first heat exchange unit 11, the second heat exchange unit 12, the third heat exchange unit 13, and the N-th heat exchange unit 14, the defrost completion times TS of the heat exchange units 11, 12, 13 and 14 are equal to each other and the compulsory finish times of the heat exchange units 11, 12, 13, and 14 are equal to each other. The present disclosure is not limited to the time shown in FIG. 8, and, of course, it is possible that the defrost completion times and compulsory finish times are set as shown in Table 2.

Hereinafter, a defrost heating operation of the outdoor heat exchanger 10 will be described in detail with reference to FIGS. 2 to 8.

First, when a user inputs a heating operation, the controller 100 may perform a general heating operation. (S1)

In the general heating operation, the controller 100 may drive the compressor 1, control the heating/cooling switching valve 2 in a heating mode, as shown in FIG. 2, and close the first, second, third and fourth hot gas valves 61, 62, 63, and 64, and adjust opening degrees of the first, second, third and N-th expansion valves 21, 22, 23, and 24 to opening degrees at which the first, second, third, and N-th expansion valves 21, 22, 23, and 24 are able to expand refrigerant.

In this case, the refrigerant compressed in the compressor 1 passes through the oil separator 4, flows into the heating/cooling switching valve 2, and flows from the heating/cooling switching valve 2 to the indoor heat exchanger 6 to be condensed. The refrigerant condensed in the indoor heat exchanger 6 is distributed and flows from the first connection flow path 30 into the first, second, third, and N-th expansion valves 21, 22, 23 and 24, then expanded in the N expansion valves 21, 22, 23, and 24, individually, and, evaporated in the first, second, third, and N-th heat exchange units 11, 12, 13 and 14. Thereafter, the refrigerant are joined in the second connection flow path 40 and then introduced into the air conditioning switch valve 2, flows from the heating/cooling switching valve 2 to the accumulator 3, and then is sucked into the compressor 1.

The air conditioner may satisfy a defrost entry condition during the general heating operation as described above, and in this case, the general heating operation may be stopped and the defrost heating operation may be started (S2)(S3).

Here, the defrost entry condition is a condition that the temperature of the outdoor heat exchanger 10 is lower than an outdoor temperature (that is, the outside temperature), and as a condition that moisture is continuously adhered to the outdoor heat exchanger 10, for example, a temperature of the outdoor heat exchanger 10 is lower than an outdoor temperature by a predetermined temperature (e.g., 10° C.) and a gradient at which an evaporation pressure (that is, a low pressure) decreases is higher than or equal to a preset gradient. On the other hand, the defrost entry condition of the present embodiment is not limited to the above-described temperature condition or inclination condition, and of course, it is possible to consider the operation cumulative time of the compressor 1, a period of time during which the outdoor heat exchanger 10 is maintained at a set temperature, or the gradient of change in the temperature of the outdoor heat exchanger 10.

The controller 100 may first defrost the N-th heat exchange unit 14 located at the lowermost when the defrost entry condition is satisfied (S3).

For defrost of the N-th heat exchange unit 14, the controller 100 may close the N-th expansion valve 14 and open the N-th hot gas valve 64, as shown in FIG. 4. When the N-th expansion valve 14 is closed and the N-th hot gas valve 64 is opened as described above, gas refrigerant at a high temperature and a high pressure (that is, hot gas) compressed in the compressor 1 flows through the N-th hot gas pipe 54, and the hot gas passes through the N-th hot gas valve 64 and then passes through the N-th heat exchange unit 14 to remove frost adhered to a surface of the N-th heat exchange unit 14 while passing through the N-th heat exchange unit 14. When the N-th heat exchange unit 14 is defrosted as described above, the first, second, and third expansion valves 11, 12, and 13 are maintained at an opening degree capable of expanding the refrigerant, and the first, second, and third hot gas valves 61, 62, and 63 may be maintained in a closed state (S3).

As described above, in the outdoor heat exchanger 10, the first, second, and third heat exchange units 11, 12, and 13 may evaporate refrigerant while performing heat exchange with outdoor air when the N-th heat exchange unit 14 is being defrosted, and the first, second, and third heat exchange units 11, 12, and 13 may function as evaporators.

The controller 100 may finish the defrost of the N-th heat exchange unit 14 when the defrost release condition of the N-th heat exchange unit 14 is satisfied and may start the defrost of the first heat exchange unit 11 (S3)(S4)(S5).

The defrost release condition of the N-th heat exchange unit 11 may be a condition that the temperature of the N-th heat exchange unit 14 sensed by the N-th defrost sensor 74 is maintained at 3° C. or higher for 30 seconds or that 4 minutes have elapsed after the defrost of the N-th heat exchange unit 11 is started during defrost of the N-th heat exchange unit 14. In this case, after the defrost of the N-th heat exchange unit 11 is started, the controller 100 may finish the defrost of the N-th heat exchange unit 14 when the temperature of the N-th heat exchange unit 14 is maintained at 3° C. or higher for 30 seconds, before elapse of 4 minutes. On the other hand, when the condition that the temperature of the N-th heat exchange unit 14 is maintained at 3° C. or higher for 30 seconds, before elapse of 4 minutes after defrost of the N-th heat exchange unit 14 is started is not satisfied, the controller 100 may finish the defrost of the N-th heat exchange unit 14 at a time point at which 4 minutes have elapsed.

The controller 100 may finish the defrost of the N-th heat exchange unit 14, and control the N-th expansion valve 14 at the opening degree at which the N-th expansion valve 14 is able to expand refrigerant, close the N-th hot gas valve 61, close the first expansion valve 11, and open the first hot gas valve 61 as shown in FIG. 5 for the defrost of the first heat exchange unit 11. When the first expansion valve 11 is closed and the first hot gas valve 61 is opened as described above, gas refrigerant at a high temperature and a high pressure (that is, hot gas) compressed in the compressor 1 flows through the first hot gas pipe 51, and the hot gas passes through the first hot gas valve 61 and then passes through the N-th heat exchange unit 14 to remove frost adhered to a surface of the first heat exchange unit 11 while passing through the first heat exchange unit 11. When the first heat exchange unit 11 is defrosted as described above, the second, third, and N-th expansion valves 12, 13, and 14 are maintained at an opening degree capable of expanding the refrigerant, and the second, third, and N-th hot gas valves 62, 63, and 64 may be maintained in a closed state (S5).

As described above, in the outdoor heat exchanger 10, the second, third, and N-th heat exchange units 12, 13, and 14 may evaporate refrigerant while performing heat exchange with outdoor air when the first heat exchange unit 11 is being defrosted, and the second, third, and N-th heat exchange units 12, 13, and 14 may function as evaporators.

The controller 100 may finish the defrost of the second heat exchange unit 12 when the defrost release condition of the first heat exchange unit 11 is satisfied and may start the defrost of the second heat exchange unit 12 (S5)(S6)(S7).

The defrost release condition of the first heat exchange unit 11 may be the same as or similar to that of the N-th heat exchange unit 14, and in this case, the controller 100 may finish defrost of the first heat exchange unit 11 when the temperature of the first heat exchange unit 11 sensed by a first defrost sensor 71 is maintained at 3° C. or higher for 30 seconds or 4 minutes have elapsed after the defrost of the first heat exchange unit 11 is started during the defrost of the first heat exchange unit 11.

Thereafter, the controller 100 may finish the defrost of the first heat exchange unit 11, and control the first expansion valve 11 at the opening degree at which the first expansion valve 11 is able to expand refrigerant, close the first hot gas valve 61, close the second expansion valve 12, and open the second hot gas valve 62 as shown in FIG. 6 for the defrost of the second heat exchange unit 12. When the second expansion valve 12 is closed and the second hot gas valve 62 is opened as described above, gas refrigerant at a high temperature and a high pressure (that is, hot gas) compressed in the compressor 1 flows through the second hot gas pipe 52, and the hot gas passes through the second hot gas valve 62 and then passes through the second heat exchange unit 12 to remove frost adhered to a surface of the second heat exchange unit 12 while passing through the second heat exchange unit 12. When the second heat exchange unit 12 is defrosted as described above, the first, third, and N-th expansion valves 11, 13, and 14 are maintained at an opening degree capable of expanding the refrigerant, and the first, third, and N-th hot gas valves 61, 63, and 64 may be maintained in a closed state (S6).

As described above, in the outdoor heat exchanger 10, the first, third, and N-th heat exchange units 11, 13, and 14 may evaporate refrigerant while performing heat exchange with outdoor air when the second heat exchange unit 12 is being defrosted, and the first, third, and N-th heat exchange units 11, 13, and 14 may function as evaporators.

The controller 100 may finish the defrost of the third heat exchange unit 13 when the defrost release condition of the second heat exchange unit 12 is satisfied and may start the defrost of the third heat exchange unit 12 (S7)(S8)(S9).

The defrost release condition of the second heat exchange unit 12 may be the same as or similar to that of the first heat exchange unit 11, and in this case, the controller 100 may finish defrost of the second heat exchange unit 12 when the temperature of the second heat exchange unit 12 sensed by a second defrost sensor 72 is maintained at 3° C. or higher for 30 seconds or 4 minutes have elapsed after the defrost of the second heat exchange unit 12 is started during the defrost of the second heat exchange unit 12.

Thereafter, the controller 100 may finish the defrost of the second heat exchange unit 12, and control the second expansion valve 12 at the opening degree at which the second expansion valve 12 is able to expand refrigerant, close the second hot gas valve 62, close the third expansion valve 13, and open the third hot gas valve 63 as shown in FIG. 7 for the defrost of the third heat exchange unit 13. When the third expansion valve 13 is closed and the third hot gas valve 63 is opened as described above, gas refrigerant at a high temperature and a high pressure (that is, hot gas) compressed in the compressor 1 flows through the third hot gas pipe 53, and the hot gas passes through the third hot gas valve 63 and then passes through the third heat exchange unit 13 to remove frost adhered to a surface of the third heat exchange unit 13 while passing through the third heat exchange unit 13. When the third heat exchange unit 13 is defrosted as described above, the first, second, and N-th expansion valves 11, 12, and 14 are maintained at an opening degree capable of expanding the refrigerant, and the first, second, and N-th hot gas valves 61, 62, and 64 may be maintained in a closed state (S9).

As described above, in the outdoor heat exchanger 10, the first, second, and N-th heat exchange units 11, 12, and 14 may evaporate refrigerant while performing heat exchange with outdoor air when the third heat exchange unit 13 is being defrosted, and the first, second, and N-th heat exchange units 11, 12, and 14 may function as evaporators.

The controller 100 may finish the defrost of the N-th heat exchange unit 13 when the defrost release condition of the third heat exchange unit 13 is satisfied and may start the defrost of the N-th heat exchange unit 13 (S9)(S10)(S3').

The defrost release condition of the third heat exchange unit 13 may be the same as or similar to that of the second heat exchange unit 12, and in this case, the controller 100 may finish defrost of the third heat exchange unit 13 when the temperature of the third heat exchange unit 13 sensed by a third defrost sensor 73 is maintained at 3° C. or higher for 30 seconds or 4 minutes have elapsed after the defrost of the third heat exchange unit 13 is started during the defrost of the third heat exchange unit 13.

Thereafter, the controller 100 may finish the defrost of the third heat exchange unit 13, and control the third expansion valve 12 at the opening degree at which the third expansion valve 12 is able to expand refrigerant, close the third hot gas valve 63, close the N-th expansion valve 14, and open the N-th hot gas valve 64 as shown in FIG. 4 for the defrost of the N-th heat exchange unit 14 (S3').

The defrost of the N-th heat exchange unit 14 performed after the defrost of the third heat exchange unit 13 may be the same as the defrost of the N-th heat exchange unit 14 initially performed when the defrost entry condition is satisfied, the defrost of the N-th heat exchange unit 14 initially performed when the defrost entry condition is satisfied may be the initial defrost (S3) of the N-th heat exchange unit 14, and the defrost of the N-th heat exchange unit 14 performed after the defrost of the third heat exchange unit 13 may be the subsequent defrost (S3') of the N-th heat exchange unit 14.

The subsequent defrost (S3') of the N-th heat exchange unit 14 may have a starting condition different from that of the initial defrost (S3) of the N-th heat exchange unit 14, but have a defrost release condition identical to that of the initial defrost (S3) of the N-th heat exchange unit 14, and the subsequent defrost (S3') of the N-th heat exchange unit 14 may have the defrost release condition identical or similar to that of the third heat exchange unit 13. In this case, the controller may finish the defrost of the N-th heat exchange unit 14 when the temperature of the fourth heat exchange unit 14 sensed by an N-th defrost sensor 74 is maintained at 3° C. or higher for 30 seconds or 4 minutes have elapsed after the defrost of the N-th heat exchange unit 12 is started during defrost of the N-th heat exchange unit 14.

As described above, the defrost release condition of the N-th heat exchange unit 14 may be a defrost release condition of the defrost heating operation, and when the defrost release condition of the N-th heat exchange unit 14 is satisfied, the controller 100 may again adjust an opening degree of the N-th expansion valve 14 to the opening degree at which the N-th expansion valve 14 expands refrigerant and close the N-th hot gas valve 64 to perform a general heating operation (S3') (S4') (S1).

Figure 9:
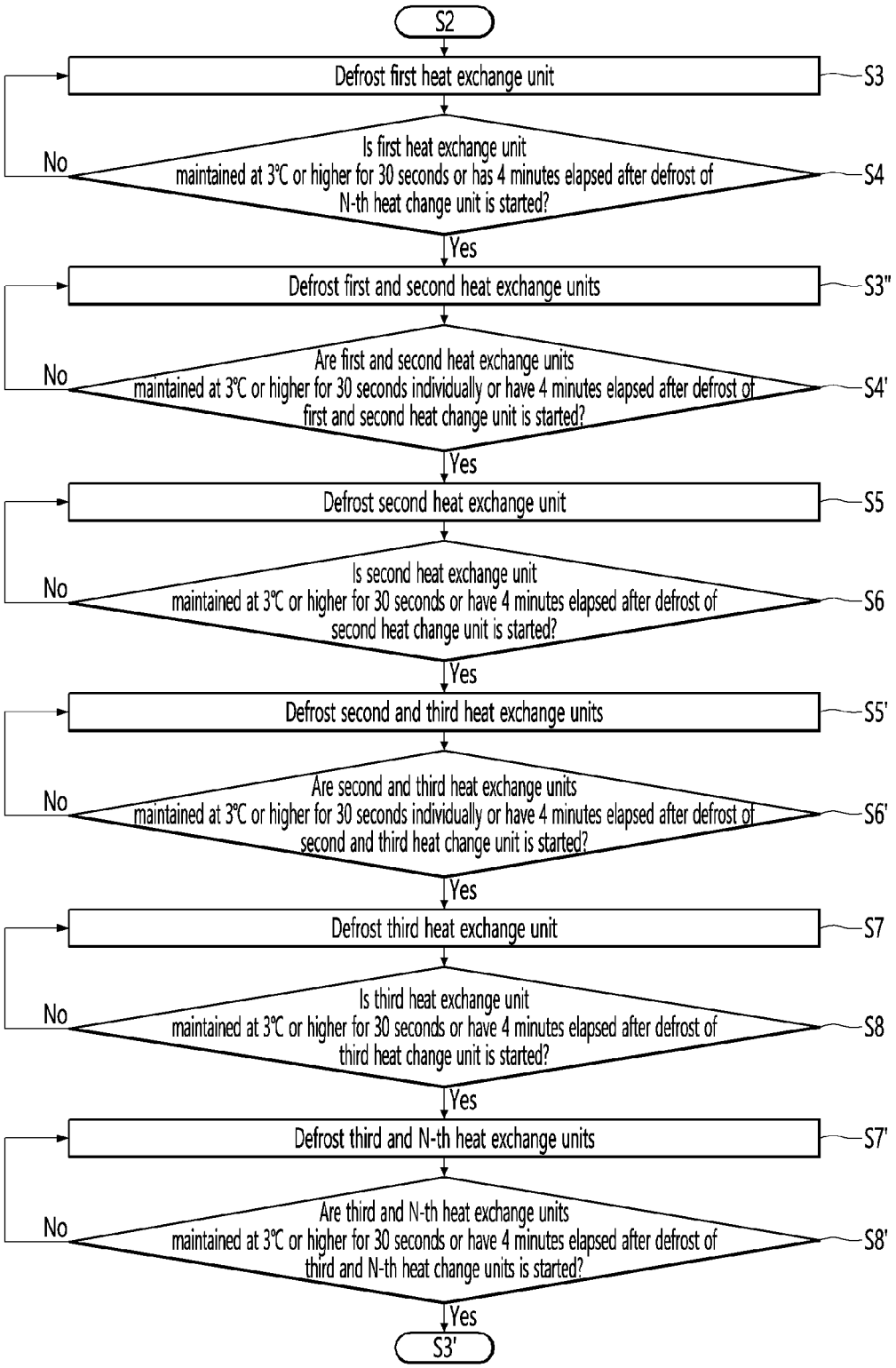
FIG. 9 is a flowchart of a method of operating an air conditioner according to another embodiment of the present disclosure.

FIG. 9 is a flowchart of a method of operating an air conditioner according to another embodiment of the present disclosure.

The controller 12 may defrost a pair of heat exchange units together between the defrosts of a pair of adjacent heat exchange units among the N heat exchange units 11, 12, 13, and 14, as described above, other control except simultaneous defrost of the pair of heat exchange units together between defrosts of the pair of adjacent heat exchange units is the same as the control according to an embodiment of the present disclosure and therefore, hereinafter, different control from the embodiment of the present disclosure is only described, and with respect to the same control as the embodiment of the present disclosure, the same reference numerals as the embodiment of the present disclosure are used, and detailed description thereof will be omitted.

Since a defrost heating operation of the present embodiment is substantially identical to the embodiment of the present disclosure in operations (S1)(S2) prior to the defrost of the first heat exchange unit 11 and the defrost (S3) of the first heat exchange unit 11, a detailed description thereof will be omitted to avoid redundant description.

Furthermore, in the present embodiment, simultaneous defrost of the first and second heat exchange units for defrosting the first and second heat exchange units 11 and 12 together (S3") may be performed between the defrost (S3) of the first heat exchange unit 11 and the defrost (S5) of the second heat exchange unit 12.

The simultaneous defrost of the first and second heat exchange units (S3") may be performed when the defrost release condition (S4) of the first heat exchange unit 11 is satisfied and the controller 100 may maintain the first hot gas valve 61 in an opened state while maintaining the first expansion valve 11 in a closed state, close the second expansion valve 12 which has been opened during defrost of the first heat exchange unit 11, and open the second hot gas valve 62 which has been closed during defrost of the first heat exchange unit 11 to perform the simultaneous defrost (S3") of the first and second heat exchange units when the temperature of the first heat exchange unit 11 sensed by the first defrost sensor 71 is maintained at 3° C. or higher for 30 seconds or 4 minutes have elapsed after the defrost of the first heat exchange unit 12 is started during defrost of the first heat exchange unit 11. When the control for the second expansion valve 12 and the second hot gas valve 62 is changed as described above, hot gas may be distributed and flow into the first heat exchange unit 11 and the second heat exchange unit 12. During the simultaneous defrost (S3") of the first and second heat exchange units, refrigerant may be evaporated while passing through the third heat exchange unit 13 and the N-th heat exchange unit 14, and the first heat exchange unit 11 and the second heat exchange unit 12 may be defrosted due to the hot gas.

On the other hand, the simultaneous defrost (S3") of the first and second heat exchange units may be finished when the defrost release condition (S4') of the first and second heat exchange units is satisfied, and the controller 100 may stop the simultaneous defrost (S3") of the first and second heat exchange units and perform defrost (S5) of the second heat exchange unit 11 when the defrost release condition (S4') of the first and second heat exchange units is satisfied during the simultaneous defrost (S3") of the first and second heat exchange units.

Here, the defrost release condition (S4') of the first and second heat exchange unit may be a condition that the temperatures sensed by the first defrost sensor 71 and the second defrost sensor 72 are maintained at 3° C. or higher for 30 seconds or 4 minutes have elapsed after the simultaneous defrost (S3") of the first and second heat exchange units is started during the simultaneous defrost of the first and second heat exchange units (S3"), and the controller 100 may finish the simultaneous defrost of the first and second heat exchange units and start the defrost of the second heat exchange unit 12 when the defrost release condition (S4') of the first and second heat exchange units is satisfied (S3") (S4')(S5).

Since the defrost (S5) of the second heat exchange unit 12 is identical to that in the one embodiment of the present disclosure, a detailed description thereof will be omitted to avoid redundant description.

Furthermore, in the present embodiment, the simultaneous defrost (S5') of the second and third heat exchange units for defrosting the second heat exchange unit 12 and the third heat exchange unit 13 together may be performed between the defrost (S5) of the second heat exchange unit 12 and the defrost (S7) of the third heat exchange unit 13.

In the defrost heating operation of the present embodiment, when the defrost release condition (S6) of the second heat exchange unit 12 is satisfied after performing the defrost (S5) of the second heat exchange unit 12, the simultaneous defrost (S5') of the second and third heat exchange units may be performed.

The controller 100 may perform the simultaneous defrost (S5') of the second and third heat exchange units when the temperature of the second heat exchange unit 12 sensed by the second defrost sensor 72 is maintained at 3° C. or higher for 30 seconds or 4 minutes have elapsed after the defrost of the second heat exchange unit 12 is started during defrost of the second heat exchange unit 12.

The controller 100 may maintain the second hot gas valve 62 in an opened state while maintaining the second expansion valve 12 in a closed state, close the third expansion valve 13 which has been opened during the defrost of the second heat exchange unit 12, and open the third hot gas valve 63 which has been closed during the defrost of the second heat exchange unit 12 to perform the simultaneous defrost (S5') of the second and third heat exchange units.

When the control for the third expansion valve 12 and the third hot gas valve 62 is changed as described above, hot gas may be distributed and flow into the second heat exchange unit 12 and the third heat exchange unit 13. During the simultaneous defrost (S5') of the second and third heat exchange units, refrigerant may be evaporated while passing through the first heat exchange unit 11 and the N-th heat exchange unit 14, and the second heat exchange unit 12 and the third heat exchange unit 13 may be defrosted by the hot gas.

On the other hand, the simultaneous defrost (S5') of the second and third heat exchange units may be finished when the defrost release condition (S6') of the second and third heat exchange units is satisfied, and the controller 100 may stop the simultaneous defrost (S5') of the second and third heat exchange units and perform defrost (S7) of the third heat exchange unit 13 when the defrost release condition (S6') of the second and third heat exchange units is satisfied during the simultaneous defrost (S5') of the second and third heat exchange units.

Here, the defrost release condition (S6') of the second and third heat exchange units may be a condition that the temperatures sensed by the second defrost sensor 72 and the third defrost sensor 73 are maintained at 3° C. or higher for 30 seconds or 4 minutes have elapsed after the simultaneous defrost (S5') of the the second and third heat exchange units is started during the simultaneous defrost (S5') of the second and third heat exchange units, and the controller 100 may finish the simultaneous defrost of the the second and third heat exchange units and start the defrost of the third heat exchange unit 13 when the defrost release condition of the second and third heat exchange units is satisfied (S5')(S6')(S7).

Since the defrost (S7) of the third heat exchange unit 13 is identical to that in the one embodiment of the present disclosure, a detailed description thereof will be omitted to avoid redundant description.

Furthermore, in the present embodiment, the simultaneous defrost (S7') of the third and N-th heat exchange units for defrosting the third heat exchange unit 13 and the N-th heat exchange unit 14 together may be performed between the defrost (S7) of the third heat exchange unit 13 and the defrost (S3') of the N-th heat exchange unit 14.

In the defrost heating operation of the present embodiment, when the defrost release condition (S8) of the third heat exchange unit 17 is satisfied after performing the defrost (S7) of the third heat exchange unit 13, the simultaneous defrost (S7') of the third and N-th heat exchange units may be performed.

The controller 100 may perform the simultaneous defrost (S7') of the third and N-th heat exchange units when the temperature of the third heat exchange unit 13 sensed by the third defrost sensor 73 is maintained at 3° C. or higher for 30 seconds or 4 minutes have elapsed after the defrost of the third heat exchange unit 13 is started during defrost of the third heat exchange unit 13.

The controller 100 may maintain the third hot gas valve 63 in an opened state while maintaining the third expansion valve 13 in a closed state, close the N-th expansion valve 14 which has been opened during the defrost of the third heat exchange unit 13, and open the N-th hot gas valve 64 which has been closed during the defrost of the third heat exchange unit 13 to perform the simultaneous defrost (S7') of the third and fourth heat exchange units.

When the control for the N-th expansion valve 14 and the N-th hot gas valve 64 is changed as described above, hot gas may be distributed and flow into the third heat exchange unit 13 and the N-th heat exchange unit 14. During the simultaneous defrost (S7') of the third and N-th heat exchange units, refrigerant may be evaporated while passing through the first heat exchange unit 11 and the second heat exchange unit 12, and the third heat exchange unit 13 and the N-th heat exchange unit 13 may be defrosted due to the hot gas.

On the other hand, the simultaneous defrost (S7') of the third and fourth heat exchange units may be finished when the defrost release condition (S8') of the third and N-th heat exchange units is satisfied, and the controller 100 may stop the simultaneous defrost (S7') of the third and N-th heat exchange units and perform defrost (S3') of the N-th heat exchange unit 13 when the defrost release condition (S8') of the third and N-th heat exchange units is satisfied during the simultaneous defrost (S7') of the second and N-th heat exchange units.

Here, the defrost release condition (S8') of the third and fourth heat exchange units may be a condition that the temperatures sensed by the third defrost sensor 73 and the N-th defrost sensor 74 are maintained at 3° C. or higher for 30 seconds or 4 minutes have elapsed after the simultaneous defrost (S7') of the the third and N-th heat exchange units is started during the simultaneous defrost (S7') of the third and N-th heat exchange units, and the controller 100 may finish the simultaneous defrost of the the third and N-th heat exchange units and start the defrost of the N-th heat exchange unit 14 when the defrost release condition of the third and N-th heat exchange units is satisfied (S7')(S8')(S3').

Here, the defrost (S3') of the N-th heat exchange unit 14 is identical to the subsequent defrost (S3') of the N-th heat exchange unit 14 according to the one embodiment of the present disclosure, and a detailed description thereof will be omitted to avoid a redundant description. Since (S4'), (S1), and (S2) after the defrost (S3') of the N-th heat exchange unit 14 are identical to those of the one embodiment of the present disclosure, detailed descriptions thereof will be omitted to avoid redundant description.

That is, the defrost heating operation of the outdoor heat exchanger of the present embodiment may be performed in the order of the defrost (S1, see FIG. 8) of the N-th heat exchange unit 14, the defrost (S3) of the first heat exchange unit 11, the simultaneous defrost (S3") of the first and second heat exchange units, the defrost (S5) of the second heat exchange unit 12, the simultaneous defrost (S5') of the second and third heat exchange units, the defrost (S7) of the third heat exchange unit 13, the simultaneous defrost (S7') of the third and N-th heat exchange units, and the defrost (S3') of the N-th heat exchange unit 14.

The simultaneous defrost (S3") of the first and second heat exchange units, the simultaneous defrost (S5') of the second and third heat exchange units, and the simultaneous defrost (S7') of the third and N-th heat exchange units, which are performed during the defrost heating operation, may cause frost to be formed between a pair of heat exchange units adjacent in the longitudinal direction, and when the outdoor heat exchanger 1 include a total of four heat exchange units, the outdoor heat exchanger 1 may be defrosted in the order of the defrost of the fourth heat exchange unit 14, the defrost of the first heat exchange unit 11, the defrost of a portion between the first heat exchange unit 11 and the second heat exchange unit 12, the defrost of the second heat exchange unit 12, the defrost of a portion between the second heat exchange unit 12 and the third heat exchange unit 13, the defrost of the third heat exchange unit 13, the defrost of a portion between the third heat exchange unit 13 and the fourth heat exchange unit 14, and the defrost of the N-th heat exchange unit 14.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

Therefore, the exemplary embodiments of the present disclosure are provided to explain the spirit and scope of the present disclosure, but not to limit them, so that the spirit and scope of the present disclosure is not limited by the embodiments.

The scope of the present disclosure should be construed on the basis of the accompanying claims, and all the technical ideas within the scope equivalent to the claims should be included in the scope of the present disclosure.

The invention claimed is:

1. An air conditioner comprising:

an outdoor unit that includes a plurality of heat exchangers that are spaced apart from one another in a vertical direction, the plurality of heat exchangers including a top heat exchanger that is located at a top position among the plurality of heat exchangers, a bottom heat exchanger that is located on a bottom position among the plurality of heat exchangers, and at least one other heat exchanger that is positioned vertically between the top heat exchanger and the bottom heat exchanger;

a plurality of expansion valves connected to the plurality of heat exchangers;

a plurality of hot gas pipes connected to the plurality of heat exchangers;

a plurality of hot gas valves connected in the plurality of hot gas pipes; and a controller configured to operate the plurality of expansion valves and the plurality of hot gas valves to defrost the plurality of heat exchangers, wherein the controller, when operating the plurality of expansion valves and the plurality of hot gas valves to defrost the plurality of heat exchangers, is configured to:

defrost the bottom heat exchanger, defrost the top heat exchanger after defrosting the bottom heat exchanger, and defrost the at least one other heat exchanger sequentially in the vertical direction from the top heat exchanger to the bottom heat exchanger after defrosting the top heat exchanger, and wherein a defrosting of each of the plurality of heat exchangers is completed after a first occurring one of:

a set temperature being maintained for a defrost completion time after the defrosting is started, or after a compulsory finish time, that is longer than the defrost completion time, having elapsed after the defrosting is started.

2. The air conditioner of claim 1, wherein the plurality of heat exchangers have different defrost completion times.

3. The air conditioner of claim 2, wherein the defrost completion times of the plurality of heat exchangers increase downward in the vertical direction between the top heat exchanger and the bottom heat exchanger.

4. The air conditioner of claim 1, wherein the plurality of heat exchangers have different compulsory finish times.

5. The air conditioner of claim 4, wherein the compulsory completion times of the plurality of heat exchangers increase downward in the vertical direction between the top heat exchanger and the bottom heater exchanger.

6. The air conditioner of claim 1, wherein the controller is configured to concurrently defrost a vertically adjacent pair of the plurality of heat exchangers.

7. The air conditioner of claim 1, wherein respective quantities of the plurality of expansion valves, the plurality of hot gas pipes, and the plurality of hot gas valves provided in the air conditioner correspond to a quantity of the plurality of heat exchangers provided in the outdoor unit, and wherein the plurality of expansion valves are connected respectively to the plurality of heat exchangers, the plurality of hot gas pipes are connected respectively to the plurality of heat exchangers, and the plurality of hot gas valves are installed respectively in the plurality of hot gas pipes.

8. The air conditioner of claim 1, further comprising a plurality of a temperature sensors coupled respectively to the plurality of heat exchangers.

9. The air conditioner of claim 1, wherein the outdoor unit further includes a fan that generates an air flow at the plurality of heat exchangers.

10. An air conditioner comprising:

an outdoor unit that includes a plurality of heat exchangers that are spaced apart from one another in a vertical direction, the plurality of heat exchangers including a bottom heat exchanger that is located on a bottom position among the plurality of heat exchangers and other heat exchangers that are positioned vertically above the bottom heat exchanger;

a plurality of expansion valves connected to the plurality of heat exchangers;

a plurality of hot gas valves connected to the plurality of heat exchangers; and a controller configured to operate the plurality of expansion valves and the plurality of hot gas valves to defrost the plurality of heat exchangers, wherein the controller, when operating the plurality of expansion valves and the plurality of hot gas valves to defrost the plurality of heat exchangers, is configured to:

defrost the bottom heat exchanger, and defrost the other heat exchangers sequentially downward after defrosting the bottom heat exchanger, and wherein a defrosting of each of the plurality of heat exchangers is completed after a first occurring one of:

a set temperature being maintained for a defrost completion time after the defrosting is started, or after a compulsory finish time, that is longer than the defrost completion time, having elapsed after the defrosting is started.

11. The air conditioner of claim 10, wherein the plurality of heat exchangers have different defrost completion times.

12. The air conditioner of claim 11, wherein the defrost completion times of the other heat exchangers increase downward in the vertical direction.

13. The air conditioner of claim 10, wherein the plurality of heat exchangers have different compulsory finish times.

14. The air conditioner of claim 13, wherein the compulsory completion times of the other heat exchangers increase downward in the vertical direction.

15. The air conditioner of claim 10, wherein the controller is configured to concurrently defrost a vertically adjacent pair of the plurality of heat exchangers.

16. The air conditioner of claim 10, wherein respective quantities of the plurality of expansion valves and the plurality of hot gas valves provided in the air conditioner correspond to a quantity of the plurality of heat exchangers provided in the air conditioner.

17. The air conditioner of claim 10, further comprising a plurality of a temperature sensors coupled respectively to the plurality of heat exchangers.

18. The air conditioner of claim 10, wherein the outdoor unit further includes a fan that generates an air flow at the plurality of heat exchangers.

* * * * *